United States Patent [19]

Lewis

[11] 4,401,007

[45] Aug. 30, 1983

[54] WIND INSTRUMENT

[76] Inventor: Jeffrey J. Lewis, 334 Sunset Ave., Venice, Calif. 90291

[21] Appl. No.: 409,810

[22] Filed: Aug. 23, 1982

Related U.S. Application Data

[63] Continuation of Ser. No. 251,838, Apr. 8, 1981, abandoned, which is a continuation-in-part of Ser. No. 106,646, Dec. 26, 1979, Pat. No. 4,320,686, which is a continuation of Ser. No. 926,459, Jul. 20, 1978, abandoned.

[51] Int. Cl.[3] ..... G10D 9/04

[52] U.S. Cl. ..... 84/380 R; 84/330; 84/384

[58] Field of Search ..... 84/330, 380 R, 382, 84/384, 385 R, 385 P

[56] References Cited

U.S. PATENT DOCUMENTS

| | | | |
|---|---|---|---|
| 845,998 | 3/1907 | Bernard | 84/385 P |
| 1,376,986 | 5/1921 | Winterhoff | 84/380 R |
| 1,505,597 | 8/1924 | Mann | 84/385 R |
| 1,722,249 | 7/1929 | Lazare et al. | 84/380 R |
| 1,786,833 | 12/1930 | Dytch | 84/385 P |
| 3,068,736 | 12/1962 | Politis | 84/380 R |
| 4,320,686 | 3/1982 | Lewis | 84/380 R |

FOREIGN PATENT DOCUMENTS

| | | | |
|---|---|---|---|
| 31804 | 6/1927 | France | 84/385 R |

*Primary Examiner*—Lawrence R. Franklin
*Attorney, Agent, or Firm*—William W. Glenny

[57] ABSTRACT

A wind instrument having a mouthpiece connected to the inner end of a tube forming an elongated resonating chamber, the tube being provided with a slot along virtually its entire length, and an elongated flexible strip closure member having its inner end fixed to the tube adjacent to the mouthpiece and the strip overlying the slot, the outer end of the strip being fixed to the tube structure adjacent to its outer end. Resilient sealing means are provided between the lower face of the strip and the slot walls whereby the closure strip closes the chamber from the mouthpiece end to a selected point where the user digitally depresses the strip into sealing relation with the slot walls, thus creating a resonating chamber of selected length, as determined by the position of the user's finger. The upper surface of the strip is smooth, permitting the user to produce glissando or bending of notes, and the strip itself is desirably of thin metal, preferably of upwardly concave transverse section to enhance longitudinal stiffness. In a preferred form of the invention the strip closure member is so contoured that no part of the closure member, in sealing position, lies within the imaginary circle or cylinder formed by a continuation of the interior surface of the cylindrical tube across the slot.

5 Claims, 17 Drawing Figures

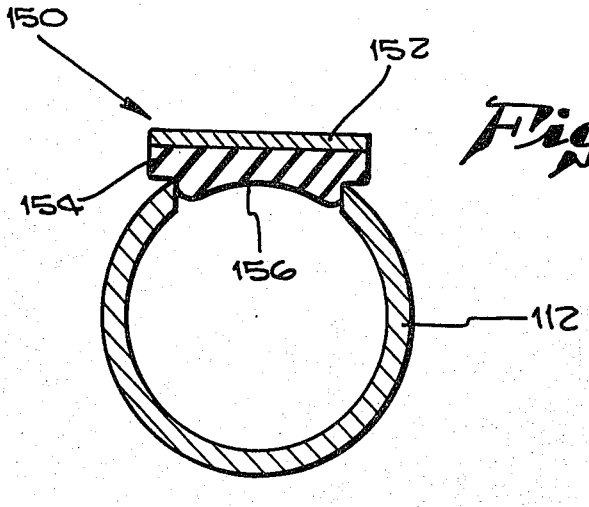
Fig. 9.
Fig. 12.
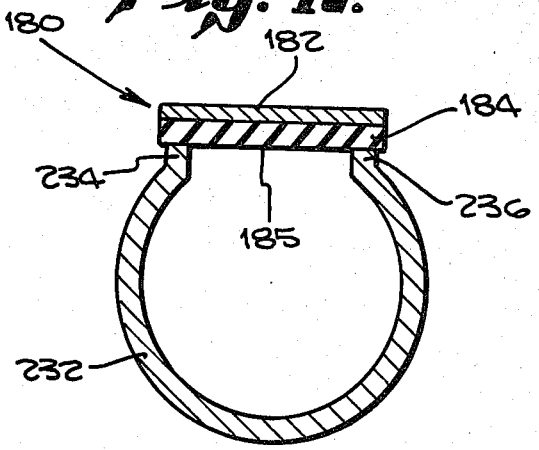
Fig. 10.
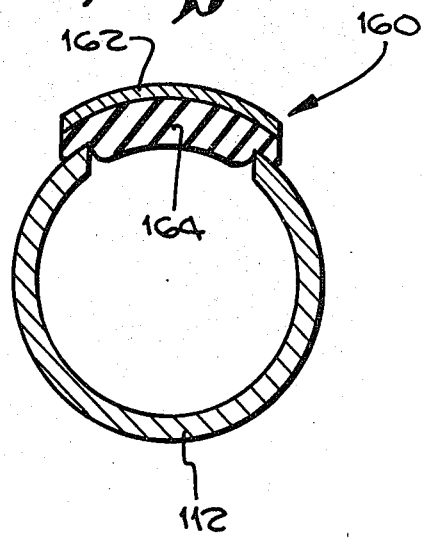
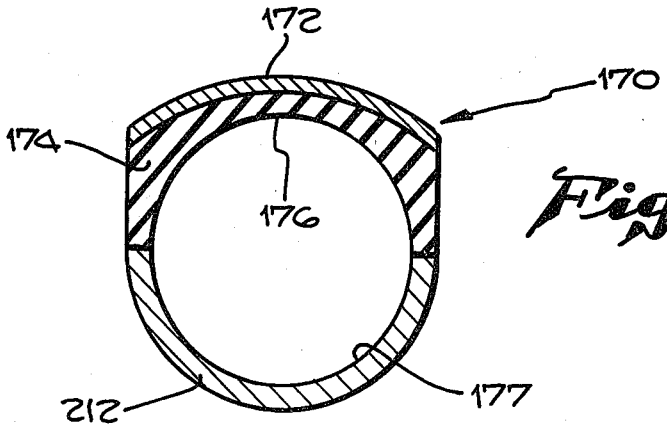
Fig. 11.

WIND INSTRUMENT

This application is a continuation of my copending Ser. No. application 06/251,838, filed Apr. 8, 1981, now abandoned, which was a continuation-in-part of my earlier application Ser. No. 06/106,646, filed Dec. 26, 1979, now U.S. Pat. No. 4,320,686, which was a continuation application of my earlier application Ser. No. 05/926,459, filed July 20, 1978, and now abandoned.

BACKGROUND AND SCOPE OF THE INVENTION

This invention relates generally to wind musical instruments of the type having a mouthpiece and an elongated resonating chamber operatively associated at one end with the mouthpiece, and has particular application to such an instrument wherein the effective length of the chamber, which controls the pitch of a musical note produced by the instrument, is selectively variable by the user continuously over the musical range of the instrument.

As is well known, the family of wind instruments includes the flute, saxophone, bassoon, clarinet, oboe and English horn, etc. Conventional instruments of this family provide a plurality of openings along the length of an elongated resonating chamber associated with the mouthpiece of the instrument, together with means by which the user can selectively close certain openings, in order thereby to adjust the effective length of the resonating chamber. In some instances, as in the case of a flute, the means for closing the openings may be the user's fingers; and in other instruments of the family, mechanical closure means are provided which may be digitally actuated by the user from open to closed positions, or from closed to open positions. In these instruments, the change of pitch from the actuation by the user of adjacent openings is necessarily a discrete change from one pitch to another; it is virtually impossible to produce a glissando or bending of a note in such instruments.

In accordance with a preferred form of the present invention, there is provided an elongated resonating chamber operatively associated with a sound-producing mouthpiece. The effective length of the chamber determines the pitch of the musical note produced by the instrument, as in the case of the conventional instruments referred to above. However, the present invention provides for an infinite or continuous variation of the effective length of the resonating chamber, under the control of the user, so that the instrument is capable of producing a glissando, bending of a note, and the like.

In the preferred form of the invention hereinafter illustrated and described hereinafter as applied to a flute, the elongated and resonating chamber is provided with a slot extending substantially the entire length of the chamber, together with means by which the user can digitally close as much as may be desired of the length of the slot from its inner end adjacent to the mouthpiece to the selected point of closure of the slot, spaced from the mouthpiece. More particularly, the closure means desirably takes the form of an elongated strip of flexible sheet material such as thin metal, having one of its ends fixed to the body of the instrument at the inner end of the slot adjacent to the mouthpiece, and means are provided at the outer end of the slot and the resonating chamber, by which to normally maintain the major portion of the length of the strip substantially spaced away from the slot, thereby leaving the slot open throughout virtually the entire length of the resonating chamber.

In playing the instrument in accordance with the present invention, the user digitally forces the closure strip into sealing relationship with the portions of the elongated chamber marginally adjacent to the slot, and in the preferred form of the invention, there may be resilient means such as sponge rubber or equivalent material, carried by the lower face of the strip, so that the digital actuation of the closure strip into contact with the instrument will create a virtually hermetically tight seal from the inner end of the strip to the point where the user applies downward force.

For certain applications, in order to enhance the purity of the tone produced by the instrument, it is desirable that the closure strip be so configured, as seen in transverse section in closed position, so that its inner surface does not interfere with the general shape of the interior surface of the tube wall. Thus, when the interior surface of the tube wall is generally cylindrical, interrupted of course by the slot as previously described, it is desirable that no portion of the closure strip, when depressed into closed or sealing position over the slot, lie within the imaginary extension of the cylindrical interior surface. It is even preferable that the inner surface of the closure strip, when the strip is depressed into closing position, be concave in in contour, having a radius of curvature equal to the radius of the interior cylindrical wall of the tube. With this configuration, the portion of the tube in which the slot is closed by the strip will have a continuous cylindrical inner wall, an arrangement which enhances the purity of tone produced by the instrument. A corresponding enhancement of tone purity may be achieved by an analogous construction of the interior surface of a key, constituting another form of invention, for selectively closing an opening—typically circular—in the wall of a wind instrument having a set of discrete spaced openings, as distinguished from the elongated slot first mentioned above. Thus the interior surface of such a key may be that of a portion of a concave cylinder having a radius of curvature equal to that of the interior wall of the tubular portion of the instrument itself.

It is accordingly the principal object of the present invention to disclose and provide a novel musical wind instrument. Another object of the invention is to provide such an instrument having a tube forming an elongated resonating chamber operatively associated with a mouthpiece, the chamber having formed therein an elongated slot throughout substantially all of its length, together with means including a flexible strip by which the user may digitally close the slot from its inner end to any desired point along the length of the strip. Other objects and purposes of the invention are to provide, in such an instrument, resilient means carried by the lower face of the strip whereby to enhance the sealing effectiveness of the closure strip; to provide, in such an instrument having a tube whose inner surface is a portion of a cylinder, a strip whose inner surface is concave having a radius of curvature substantially equal to the radius of said cylinder; to provide, in such an instrument, a strip having an upwardly concave transverse section whereby to enhance its longitudinal stiffness; and for other and additional purposes as will become clear from a reading of the following description of a preferred embodiment of the invention, taken in connection with the accompanying drawings.

BRIEF DESCRIPTION OF THE DRAWINGS

FIG. 1 is a top plan view of a flute embodying the present invention.

FIG. 2 is a side elevational view of the flute of FIG. 1.

FIG. 3 is a fragmentary sectional view, on an enlarged scale, taken on arrows III—III of FIG. 1, showing, in dotted outline, the strip in its position when depressed by the user's finger at a selected point along the tube.

FIGS. 4 and 5 are sectional views taken on arrows IV—IV and V—V respectively of FIG. 3.

FIG. 6 is a perspective view of the present invention incorporated in a clarinet.

FIG. 7 is a fragmentary view taken on the arrows VII—VII of FIG. 6, showing an octave key which may be used compatibly with the present invention.

FIGS. 8–12 inclusive are views corresponding to FIG. 4 showing modified forms of the strip.

DETAILED DESCRIPTION

Figures 1, 2, 3, 4, 5, 6, 7, 8:
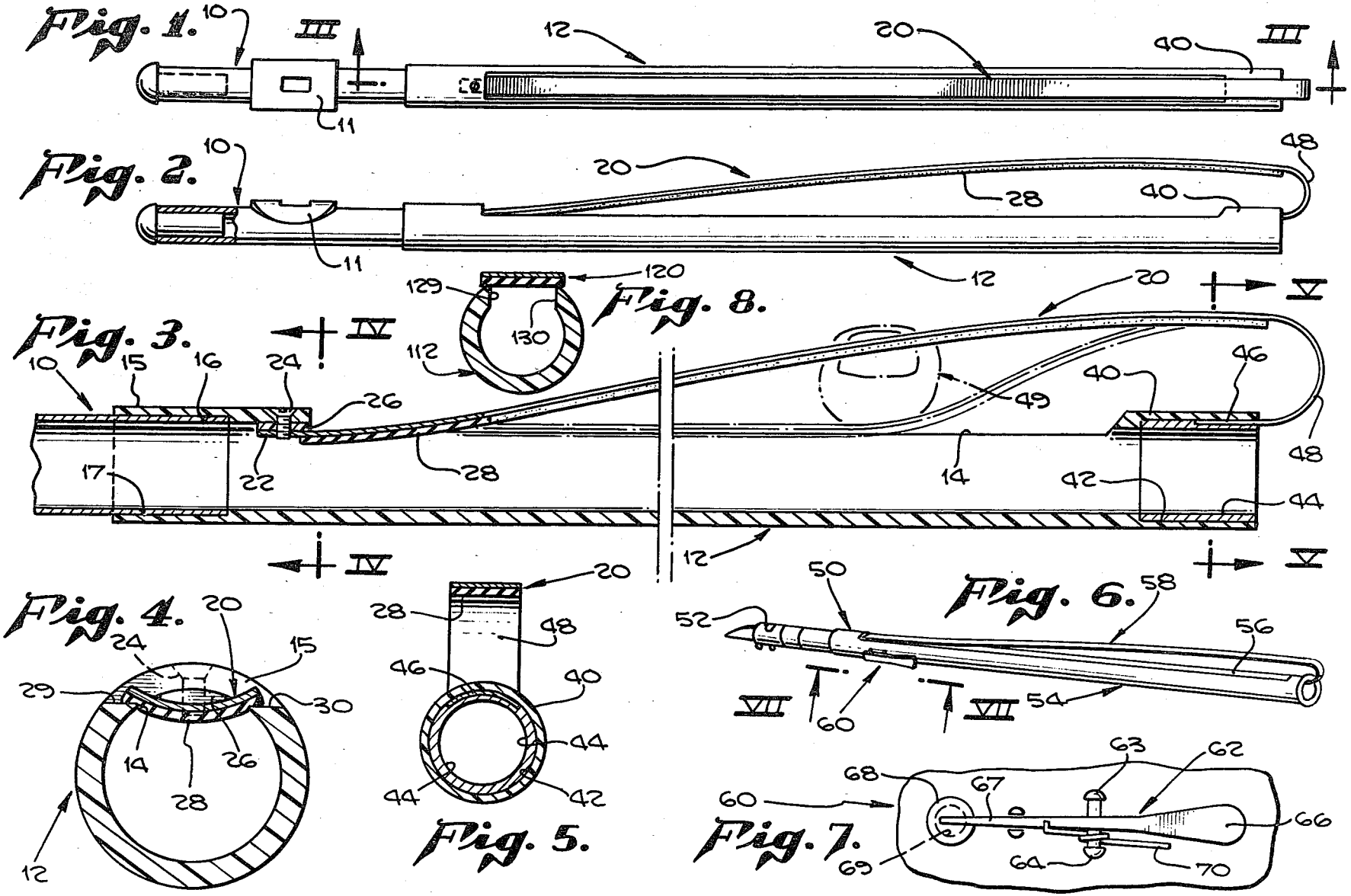

In FIGS. 1 and 2 there is shown a flute embodying one form of the present invention and including a mouthpiece indicated generally at 10 having a conventional lip plate 11 and, operatively associated with the mouthpiece, means forming an elongated resonating chamber in the form of a longitudinally extending tube indicated generally at 12. As best seen in the sectional views of FIGS. 3 and 4, a slot 14 extends along tube 12, preferably in the upper portion thereof when the instrument is held with mouthpiece 10 in its normal position as seen in FIG. 2. Tube 12 includes a non-slotted portion 15 having a counterbore 16 for frictionally receiving the cylindrical end 17 of the mouthpiece.

Means are provided in accordance with the invention for closing slot 14 of tube 12 along a selected length extending from the inner or mouthpiece end of the tube. In the present form of the invention, such means are shown as taking the form of an elongated closure strip indicated generally at 20, desirably made of flexible sheet material such as thin metal. The innermost end 22 of strip 20 is attached to the non-slotted portion 15 of the tube by attachment means here shown as including a self-tapping screw 24 extending through a radial bore in the non-slotted tube portion 15 and a spacer element 26, the lower part of the screw being threaded into strip end portion 22. Strip 20 has a smooth upper surface, and is desirably pre-formed so that it is concave upwardly in transverse section, in order to enhance its longitudinal stiffness, and spacer 26 serves to maintain that concave contour.

Commencing just outwardly of screw 24, the lower convex face of the strip, at least along marginal portions of that face, is provided with a layer 28 of resilient material such as sponge rubber or equivalent substance, adhesively attached to the strip. Layer 28 is thus in contact with the edges 29 and 30 of tube 12 which define slot 14 at and immediately adjacent to the inner end of the slot. As will be later understood, the resilient layer 28 serves also to seal virtually hermetically with the slot edges throughout a selected length of the tube, during playing of the instrument.

At the opposite end of the tube from the mouthpiece, means are provided for supporting the distal end of strip 20 on the distal end of tube. As seen in the right portions of FIGS. 2 and 3, the distal end of tube 12 includes a non-slotted cylindrical head 40 which may be provided with a counterbore 42 into which a slightly resilient locking ring 44 is tightly received along with the outermost end 46 of the strip. Resilient layer 28 terminates at or slightly outwardly of alignment with the outer end of slot 14, since its function is only to seal the slot when strip 20 is forced downwardly. Thus strip 20 includes a bowed portion 48 extending through approximately 180° of arc above the tube head 40, thereby normally maintaining the major portion of the length of strip 20 spaced above tube 12 and hence with resilient layer 28 out of contact with edges 29 and 30 flanking slot 14. If strip 20 is made wider, it may have sufficient resilience to maintain bowed portion 48 without being curved. Thus, in the FIG. 8 embodiment, strip 120 is shown wider and flat. Tube 112 is also modified because wider strip 120 can reach vertical edges 129 and 130 which are farther apart than the inside of edges 29 and 30 (FIG. 4).

The FIG. 8 arrangement offers advantages over the FIG. 4 one in that flat strip 120 does not interfere with the circular cross section of the tube which would adversely affect sound qualities.

If thinner walled tubing is used, a flat strip may interfere with a circular cross section. Therefore, a collar in the form of a pair of raised ribs extending the length of the tube could be formed flanking slot 14 so that strip 120 would contact the upper surfaces of the ribs rather than edges 129 and 130. The ribs could be formed during forming of the tube.

Playing of the instrument by the user will now be described in connection with FIG. 3. A user's fingers or thumb indicated generally at 49 may be depressed downwardly on the upper smooth surface of closure strip 20 at a selected point along the length of the strip. The resulting musical note, when the user blows on mouthpiece 10, will be of a certain pitch, and it will be noted that the user can slide his thumb or finger 49 toward or away from mouthpiece 10 along strip 20, thereby closing a smaller or greater portion of slot 14 and thus continuously varying the effective length of the resonating chamber formed by the closed portion of tube 12, i.e. the portion of tube 12 between the user's finger 49 and the mouthpiece 10.

As earlier noted, the principles of the present invention are applicable to other musical instruments of the wind family, and in FIG. 6 there is shown a clarinet embodying the present invention. Thus a clarinet indicated generally at 50 includes a conventional mouthpiece 52 attached to an elongated tube indicated generally at 54, which is provided throughout almost its entire length with a slot 56, the tube and slot thus corresponding to tube 12 and slot 14 previously described. Similarly, a strip indicated generally at 58 may be identical to strip 20, being concave upwardly in transverse section and having adhesively attached to is lower convex surface a resilient layer for sealing with the side edges of the tube defining slot 56. The ends of strip 58 are attached to tube 54 in the same way as strip 20 is attached to tube 12.

Playing of clarinet 50 is accomplished in substantially the same way as playing of the flute of FIGS. 1–3, i.e. by digital or pollical pressure by the user downwardly on the upper smooth surface of strip 58, and the same glissando and bending effects can be accomplished as previously described in connection with the flute. Clarinet 50 may be provided with an octave key indicated generally at 60 for shifting the pitch of notes produced by the instrument by a musical octave, as is well known in the art. Thus octave key 60, seen in greater detail in FIG. 7, includes an arm indicated generally at 62 extending parallel to the longitudinal axis of the instrument and mounted for pivotal rocking movement by suitable support means 63, 64, about an axis transverse to the length of the instrument. One end 66 of the arm 62 is a finger rest, the other end 67 of arm 62 carrying a closure member 68 which is adapted to selectively close an opening 69 formed in the wall of the instrument. Resilient means including a spring 70 may be provided to maintain the octave key so that the closure member 68 normally closes the opening 69, and the user may open the opening by depressing finger rest 66, all as is well known in the art.

The metal of strip 20 is preferably a spring steel such as a conventional flat spring as used in clocks, or a spring with a reverse crown. For some applications it may be desirable to use a coil spring of the type known as "constant force," in which the force needed to unwind the coil is substantially constant throughout the unwinding process. It will be noted that, when strip 20 is depressed, the portion of the strip from the finger toward the mouthpiece seals the slot below the strip.

FIGS. 9, 10, 11 and 12 are sectional views, corresponding generally to FIG. 4, showing alternate constructions of the closure strip in its sealing relation with the slot in the tube. Thus in FIG. 9 the strip assembly indicated genrally at 150 includes a strip 152 of metal or equivalent stiff material having laminated or bonded to its lower surface a sealing body 154 of resilient material. Seal 154 is provided with a concave lower surface 156 having a radius of curvature equal to the radius of the interior surface of the tube wall. Thus the surface 156 forms a continuation of the internal contour of the tube across the slot, thereby enhancing the quality of the tone produced by the instrument.

In FIG. 10 the strip assembly indicated generally at 160 includes a strip 162 of metal or equivalent stiff material upwardly convex and having laminated or bonded to its lower surface a sealing body 164 of resilient material. It will be noted that none of body 164 is within the imaginary circle formed by the interior surface of the tube and its continuation across the slot.

In FIG. 11 the slot in tube 212 extends throughout a semicircle as seen in section. The strip assembly indicated generally at 170 includes a strip 172 of metal or equivalent stiff material having laminated or bonded to its lower surface a layer 174 of resilient material which has an inner concave surface 176 constituting, when in closed position, a continuation of the inner surface 177 of tube 212.

In FIG. 12 the tube 232 embodies a modified construction providing a pair of upstanding lips 234 and 236 extending longitudinally of the tube and constituting a sort of collar along the tube. The strip assembly indicated generally at 180 includes a strip 182 of metal or equivalent stiff material having laminated or bonded to its lower surface a sealing body 184 of resilient material whose lower surface 185 is desirably tangent to the imaginary circle formed by a continuation of the cylindrical inner surface of the tube. As will be seen, only marginal portions of body 184 are needed to seal with the upper edges of lips 234 and 236.

It will be noted that in each of FIGS. 9, 10, 11 and 12, as in FIG. 8, no portion of the strip assembly enters the imaginary circle or cylinder formed by a continuation of the interior surface of the cylindrical tube itself, thereby avoiding any interference with the purity of tone created by the instrument.

It will also be noted, in connection with the strip of FIG. 10 or FIG. 11, that the upwardly convex shape of the metal portion of the strip will cause the strip to bend sharply, or "oilcan," at the point where the user's finger or thumb depresses the strip assembly into contact with the tube, thus more precisely defining the point at which the closed portion of the tube terminates for any particular fingering of the strip assembly.

Figure 14:
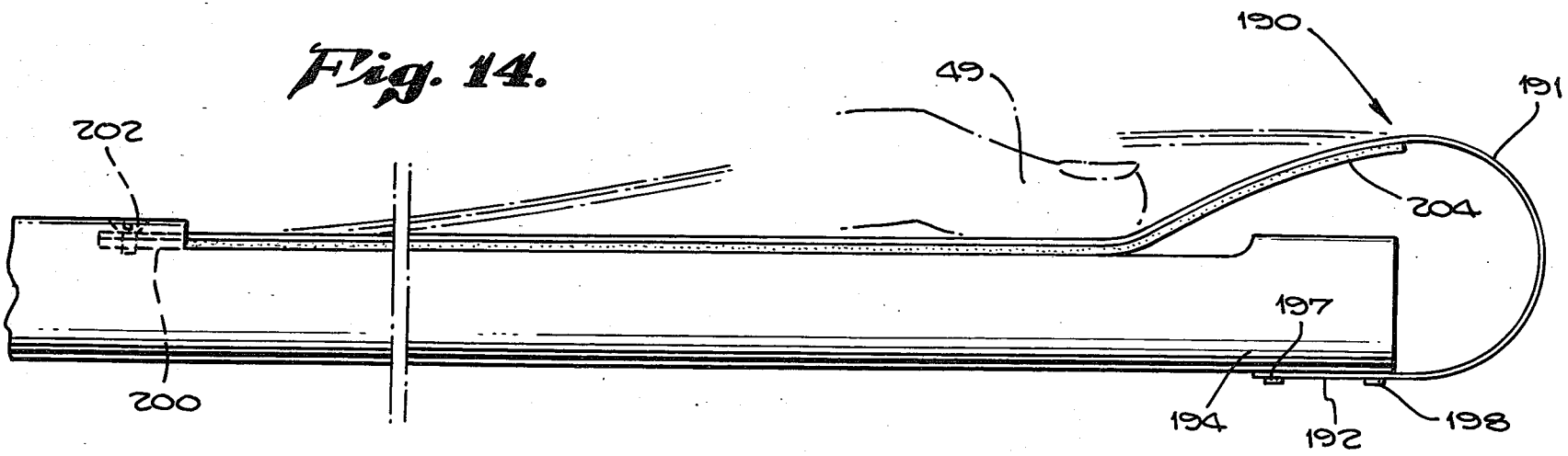
FIG. 14 is a side elevational view of the instrument of FIG. 13 with the strip in its operative position.
Figure 13:
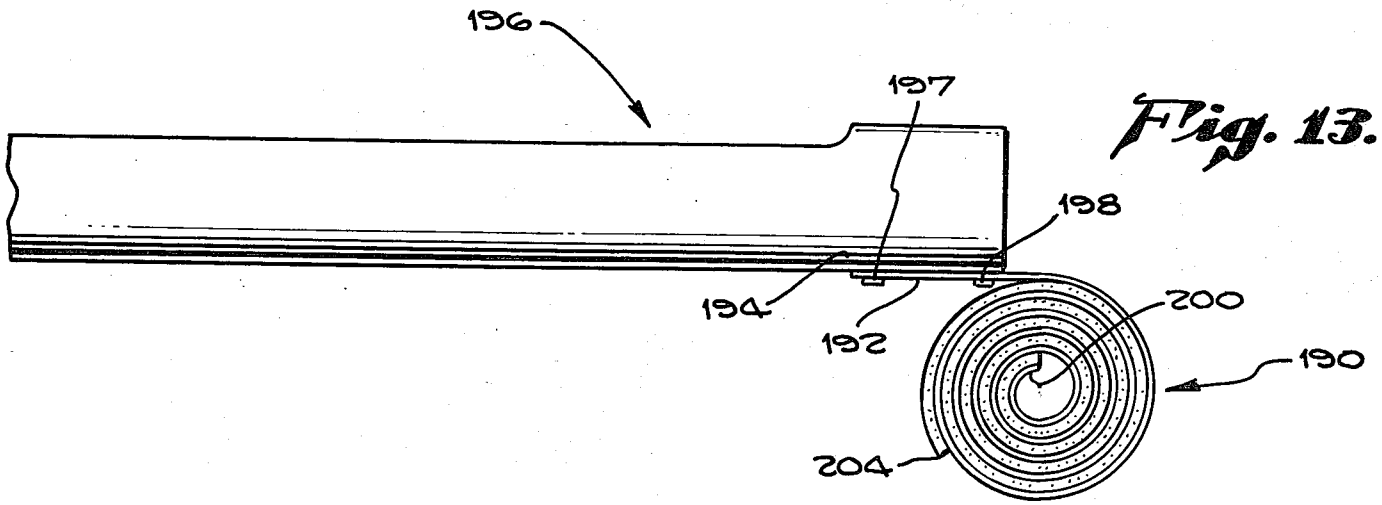
FIG. 13 is a fragmentary side elevational view of the distal end portion of an instrument in accordance with the invention showing a modified form of closure strip as it is initially attached to the distal end, before the strip is mounted in its operative relation with the instrument body.

FIGS. 13 and 14 show details of a preferred construction using a coiled spring, desirably a constant force spring in the spring assembly. Thus a spring assembly indicated generally at 190 includes a metal strip 191 whose outer end 192, as seen in FIG. 13, is initially attached to the outer end 194 of a slotted tube indicated generally at 196 by suitable means 197, 198. The spring assembly is then uncoiled into its position seen in FIG. 14, with the innermost end 200 of the coil attached by means 202 to the tube near the mouthpiece (not shown in FIG. 14), in a manner similar to the construction previously described in connection with FIGS. 1, 2 and 3. Strip 191 has bonded thereto resilient sealing means 204 to contact the tube along the edges of the tube slot, as previously described. Strip assembly 10 desirably has a sectional construction exemplified by that shown in FIG. 10 or 11, with the strip itself upwardly convex, so that it oilcans when depressed by the user's finger 49 as seen in FIG. 14.

Figure 15:
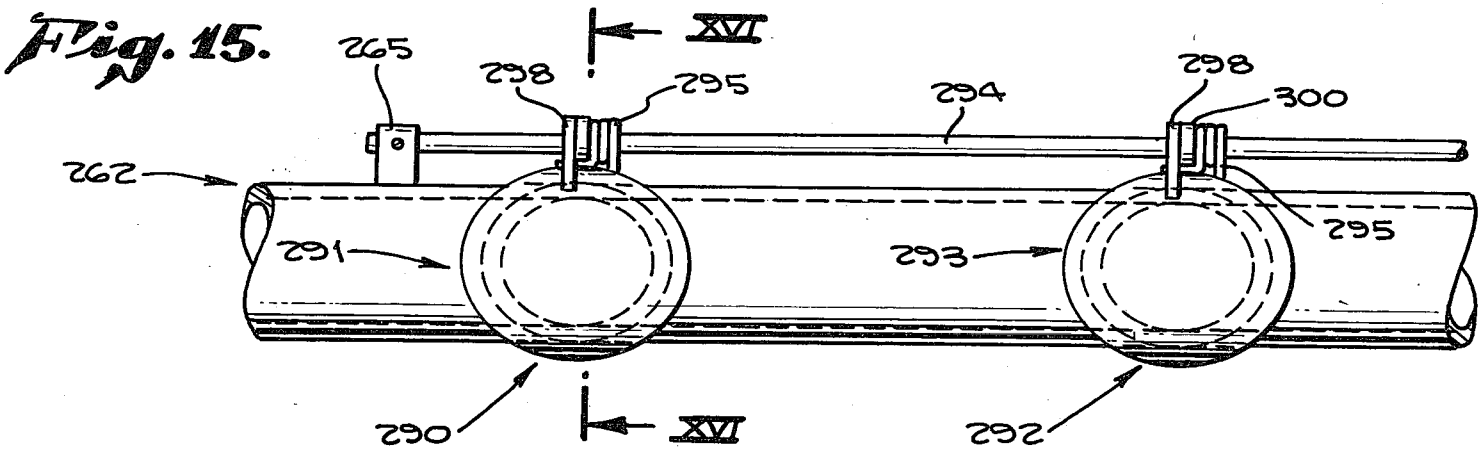
FIG. 15 is a fragmentary side view of a wind instrument having discrete openings along the tube length, and constituting another form of the present invention.
Figure 16:
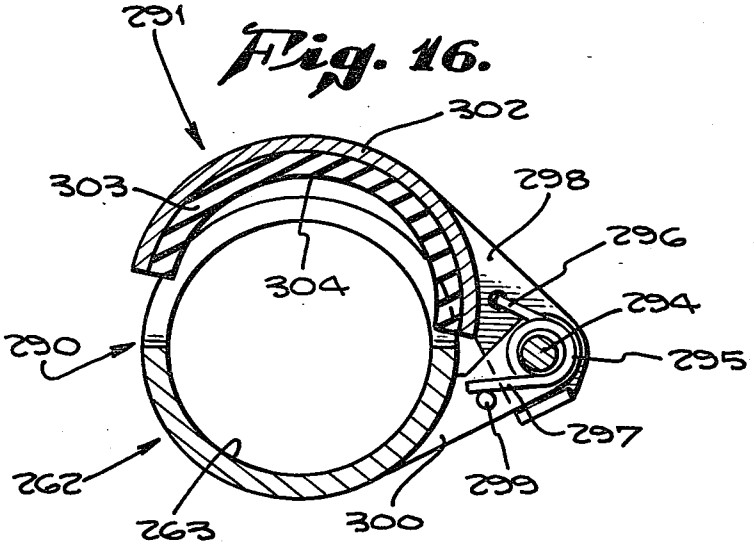
FIGS. 16 and 17 are sectional views taken along arrows XVI—XVI of FIG. 15 and showing the closure key in open and closed positions respectively.
Figure 17:
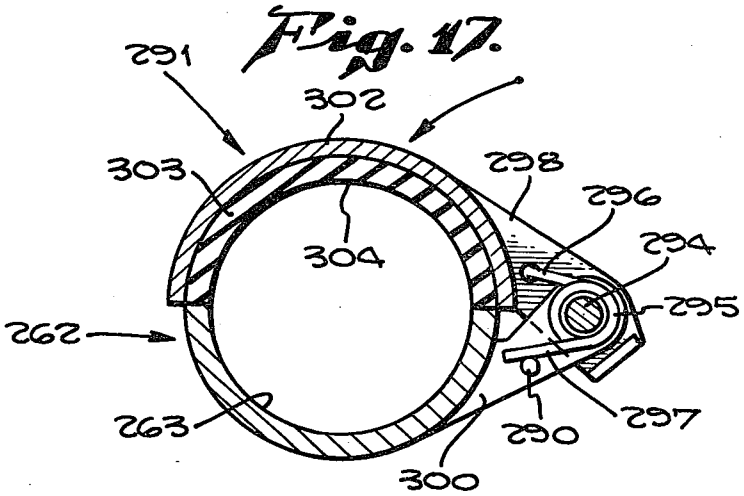

FIGS. 15, 16 and 17 show a wind instrument having discrete openings spaced along its tuube, but otherwise embodying advantageous characteristics of the present invention. Thus the tube indicated generally at 262 is provided with discrete openings indicated generally at 290 and 292, it being understood that additional such openings are provided spaced along the length of tube 262. Means are provided, selectively operable by one or more of the user's fingers, to close one or more of the openings. Such means are here shown as keys indicated generally at 291 and 293 for closing the respective openings 290 and 292. Each key is pivotally mounted on a rod 294 mounted on support means including post 265 fixed to the tube, and extending parallel to the tube, it being understood that at least one more support post (not shown) is provided in order to hold rod 294 in its position seen in FIGS. 15–17.

Keys 291 and 293 are identical in construction, and key 291 will be described in detail. The pivotal mounting of key 291 on rod 294 includes resilient means biasing the key open, such means being illustratively shown as a small coil spring 295. The spring has angularly spaced arms 296 and 297, the former being attached to a web portion 298 of key 291, and the latter abutting a post 299 carried by an element 300 fixed to tube 262 and projecting radially outwardly therefrom.

As seen in FIGS. 16 and 17, key 291 includes a rigid backing member 302 having a layer of resilient material 303 bonded to its inner surface. Key 291 is circular as seen in projection in FIG. 15, and is semicircular as seen in the sectional views, FIGS. 16 and 17. In operation the user depresses key 291 into its closed position of FIG. 17, in which the inner surface 304 of resilient material 303 forms a continuation of the inner surface 263 of tube 262, thus contributing to the purity of tone as previously discussed.

Modifications and changes from the illustrative forms of the invention herein described and illustrated are within the contemplation of the invention, and are intended to be embraced within the scope of the following claims.

I claim:

1. In a wind instrument, the provision of:

mouthpiece means for producing a sound;

tubular means forming an elongated resonating chamber operatively associated at one end with the mouthpiece means, the effective length of the chamber serving to control the pitch of a musical note produced by the instrument;

means selectively actuable by the user for continuously varying the effective length of the chamber including an elongated slot extending substantially the length of the chamber; and closure means digitally operable by the user for closing the slot from its end adjacent to the mouthpiece means to a selected point spaced toward the other end of the slot, the closure means, when in closed position, lying wholly outside an imaginary circle including a continuation across the slot of the interior surface of the tube, said closure means including a longitudinally extending closure strip assembly of flexible but stiff sheet material, upwardly convex as viewed in transverse section, having one end fixed to the tubular means adjacent to the mouthpiece, and including means for resiliently supporting the distal end of the strip spaced above the outer end of the slot, said assembly including a layer of resilient sealing material bonded to the lower surface of said sheet material.

2. The invention as defined in claim 1 including resilient sealing material carried on the lower surface of the strip for sealingly contacting marginal portions of the tubular means defining the slot.

3. The invention as defined in claim 1 wherein the upper surface of the strip is smooth.

4. The invention as defined in claim 1 wherein the lower surface of said sealing material is concave having a radius of curvature equal to the radius of the interior surface of the tube.

5. The invention as defined in claim 4 wherein said lower surface of said sealing material, when in closed position, lies on said imaginary circle.

* * * * *